US005593309A

United States Patent [19]

Post et al.

[11] Patent Number: 5,593,309

[45] Date of Patent: Jan. 14, 1997

[54] ELECTRICAL CONNECTOR HAVING IMPROVED LATCHING/UNLATCHING FEATURE

[75] Inventors: Lothar A. Post, Offenbach; Jörg Kunze, Rüsselsheim, both of Germany

[73] Assignee: The Whitaker Corporation, Wilmington, Del.

[21] Appl. No.: 362,303

[22] Filed: Dec. 22, 1994

[30] Foreign Application Priority Data

Feb. 10, 1994 [GB] United Kingdom ..... 9402570

[51] Int. Cl.[6] ..... H01R 13/62

[52] U.S. Cl. ..... 439/157; 439/462; 439/347

[58] Field of Search ..... 439/152–160, 439/462, 347

[56] References Cited

U.S. PATENT DOCUMENTS

| | | | |
|---|---|---|---|
| 4,332,432 | 6/1982 | Colleran | 339/75 M |
| 4,586,771 | 5/1986 | Kraemer et al. | 339/75 MP |
| 5,169,327 | 12/1992 | Hatagishi | 439/157 |
| 5,172,998 | 12/1992 | Hatagishi | 439/157 |
| 5,183,408 | 2/1993 | Hatagishi | 439/157 |
| 5,269,696 | 12/1993 | Okada et al. | 439/157 |
| 5,322,383 | 6/1994 | Saito et al. | 439/157 |
| 5,326,274 | 7/1994 | Pfaff et al. | 439/157 |
| 5,427,540 | 6/1995 | Taguchi | 439/157 |
| 5,443,393 | 8/1995 | Okumura et al. | 439/157 |
| 5,453,018 | 9/1995 | Ito et al. | 439/157 |
| 5,462,447 | 10/1995 | Boiret et al. | 439/347 |
| 5,474,461 | 12/1995 | Saito et al. | 439/157 |
| 5,474,462 | 12/1995 | Yamanashi | 439/157 |

FOREIGN PATENT DOCUMENTS

| | | | |
|---|---|---|---|
| 0512323A1 | 11/1992 | European Pat. Off. . | |
| 3730020 | 9/1988 | Germany | 439/347 |

*Primary Examiner*—David L. Pirlot
*Assistant Examiner*—Brian J. Biggi
*Attorney, Agent, or Firm*—Driscoll A. Nina, Jr.

[57] ABSTRACT

An electrical connector assembly is comprised of a housing member having a slidable cover, together which is interconnectable to a header member. The header includes camming grooves positioned on inside surfaces of upstanding walls whereas the connector assembly includes locking lugs positioned on outside surfaces of the cover member. The cover member is transversely slidable relative to the housing such that moving the cover transversely can bring the connector assembly into full electrical engagement with the header assembly.

19 Claims, 5 Drawing Sheets

ELECTRICAL CONNECTOR HAVING IMPROVED LATCHING/UNLATCHING FEATURE

BACKGROUND OF THE INVENTION

1. Field of the Invention

The subject of the invention is directed to an electrical connector having a latching/unlatching mechanism comprised of a transversely movable member having either an inclined groove or a locking lug, where the sliding member slides relative to an electrical connector housing where the electrical connector housing either includes the respective mating incline groove or the locking lug.

2. Description of the Prior Art

It is known from German Patent 36 45 179 to provide a latching mechanism comprised of a U-shaped slide carrying inclined grooves on the inside surfaces of the latching slide where the latching slide moves transversely relative to a first housing, such that a second housing carrying locking lugs can be brought into mating engagement by the latching mechanism. The locking slide includes axial entry slot portions which feed into the inclined portions such that the locking lugs can be brought into alignment with the inclined groove portions. When the locking slide is moved in a transverse direction relative to the mating direction of the two connectors, the locking lugs are cammed downwardly into the inclined grooves causing the two connectors to move axially relative to each other.

It is also known from German Utility Model 92 05 859 to provide an inner housing carrying the electrical contacts, and an outer housing portion which slides transversely relative to the inner housing portion, where the outer housing portion carries the inclined grooves for camming the two mating connectors together.

In either of these two examples, a disadvantage is that a separate cover member is necessary to organize the insulated conductors which lead to the individual terminals in the inner housings, and is required to incorporate some type of strain relief mechanism to prevent tension on the wires causing disconnection of the wires to the individual terminals. This separate cover member causes many redundant parts as well as time consuming installation.

SUMMARY OF THE INVENTION

It is an object of the invention to provide an improved camming slide type latching mechanism.

It is a further object of the invention to provide an improved electrical connector assembly having a camming slide type latching/unlatching function where the number of components comprising the assembly is reduced.

The objects of the invention were accomplished by providing an electrical connector assembly comprised of first and second electrical connectors, where said first connector includes a camming slide having either inclined camming grooves or camming lugs, with said second connector having either camming lugs or camming grooves, said assembly being characterized in that said camming slide is profiled as a cover member movable transversely of said first connector in an axially retained manner, from a prelocked position, where said camming lugs can enter said camming grooves, to a position where said cover member substantially encloses a rear wire entry face of said first connector.

DETAILED DESCRIPTION OF THE PREFERRED EMBODIMENT

Figure 1:
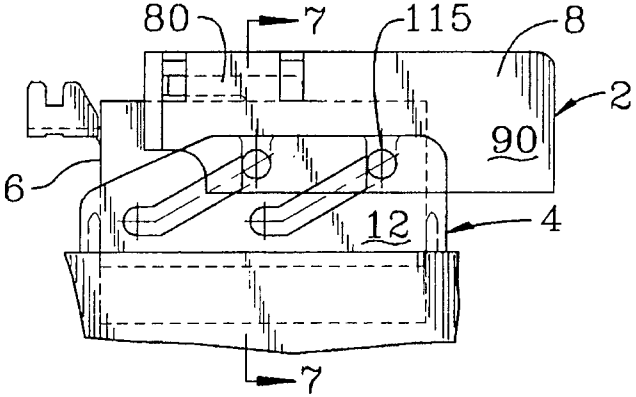
FIG. 1 is a side plan view of the connector assembly in a partially assembled condition prior to the transverse movement of the locking slide.

With reference first to FIG. 1, an electrical connector assembly is shown comprising a female connector 2 preassembled to a header connector 4. The connector 2 is comprised of an inner housing member 6 and an outer sliding cover member 8. The male header 4 is comprised of a housing body 10 having upstanding walls 12 which carry the inclined camming grooves shown generally at 14. The grooves 14 are comprised of an axially extending entry slot 16 contiguous with an inclined slot portion 18. Medially positioned between the two upstanding walls 12 is a shroud member 20 which preferably surrounds a plurality of an assembly of pin members 22 and/or tab members 24.

Figure 3:
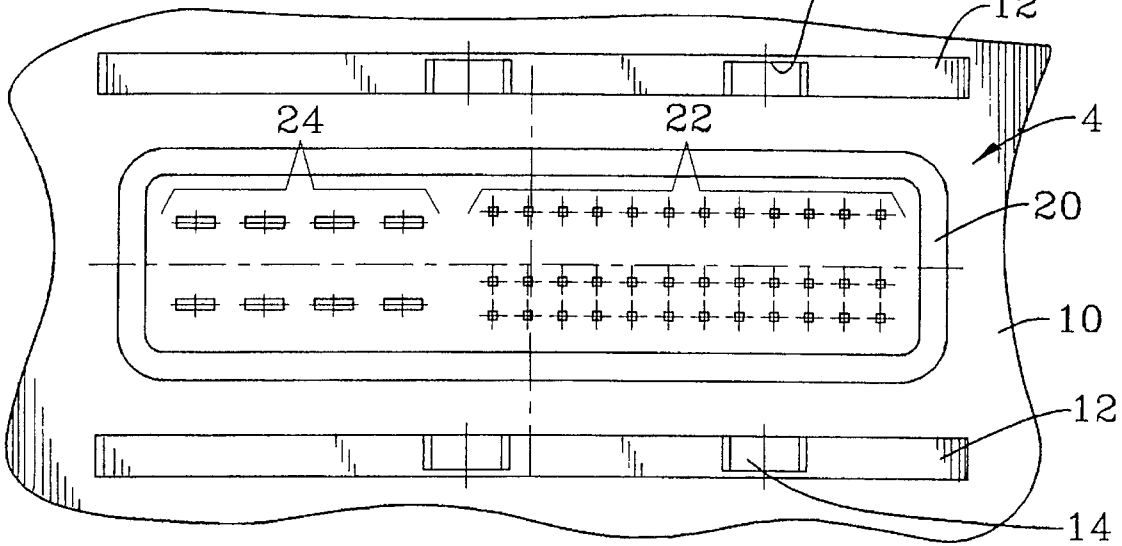
FIG. 3 is an upper plan view of the male tab header.

With respect now to FIGS. 4–7 the electrical assembly 2 will be described in greater detail. The inner housing 6 includes a front wall 26 extending the full length thereof, having pin receiving openings at 28 to receive corresponding pins 22 (FIG. 7) and slots 30 (FIG. 4) to receive corresponding tabs 24 (FIG. 3). The inner housing 6 further comprises a central wall 32 defining separate module receiving chambers on either side thereof. The housing 6 further comprises side walls 34 on either side thereof providing openings at each end thereof, for receiving from the left side as viewed in FIG. 4, an electrical connector housing 36, and from the right side thereof connector housings 38 and 40. An intermediate wall 42 (FIG. 5) is positioned on the right side of wall 32 to accommodate the two inner housings 38 and 40.

Figure 6:
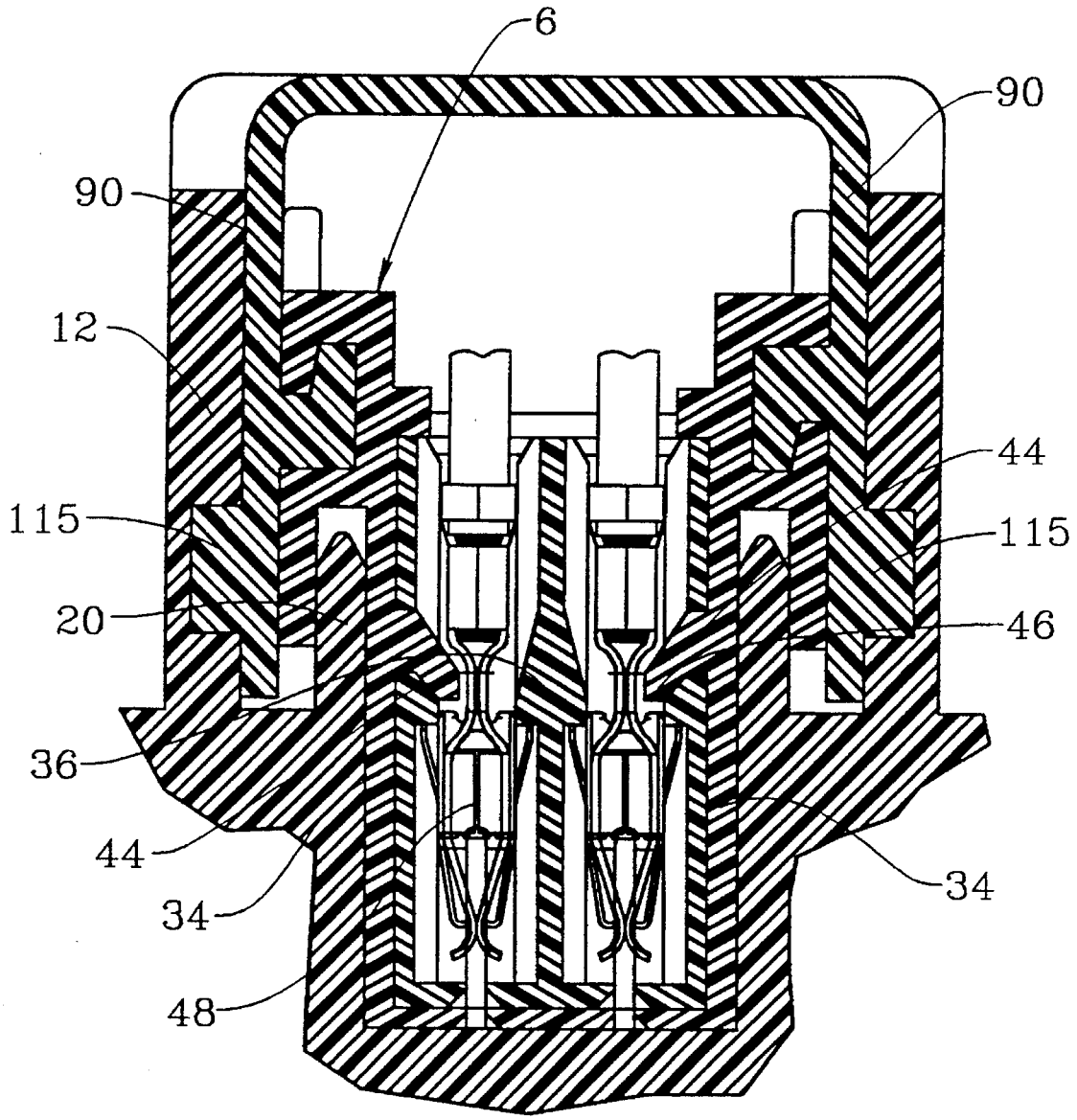
FIG. 6 is a cross sectional view through lines 6—6 of FIG. 2.

As shown best in FIG. 6, the side walls 34 include locking arms 44 on each side thereof which correspond with openings 46 in the side walls of the housing 36. The openings 46 extend the full length of housing 36, thereby allowing the slidable receipt of the housing 36 into the housing 6 from the left side of wall 32 as viewed in FIG. 4. The combination of the locking members 44 and the openings 46 provide axial retention of the two housing members 36 and 6, as well as a secondary locking feature for the terminals 48 within the housing 36. Similarly, the side walls 34 on the right side of the intermediate wall 32 include locking members 50 and 52 which allow for the slidable receipt of the housings 38 and 40 as well as the secondary retention of the terminals 54 within the housings 38 and 40. Housing 6 further comprises an integral outer ring 60 forming an internal peripheral groove 62 which is profiled to be received over the shroud 20 when in the fully locked position. Preferably a peripheral interfacial seal will be located against surface 64 such that when in the fully engaged position of FIG. 6, the tip of the peripheral shroud 20 presses against the interfacial seal 20 sealing the two connector assembly components. Two keyed grooves 68 and 70 are further provided in the housing 6, in upper extension arms 72 and 74 and will be described in greater detail herein. Finally, as best viewed in FIG. 4, an integral latch arm 80 extends from an upper section of the housing member 6, and is used for holding the cover member 8 in a prelatched and final latched position as will be described in greater detail herein.

Figure 4:
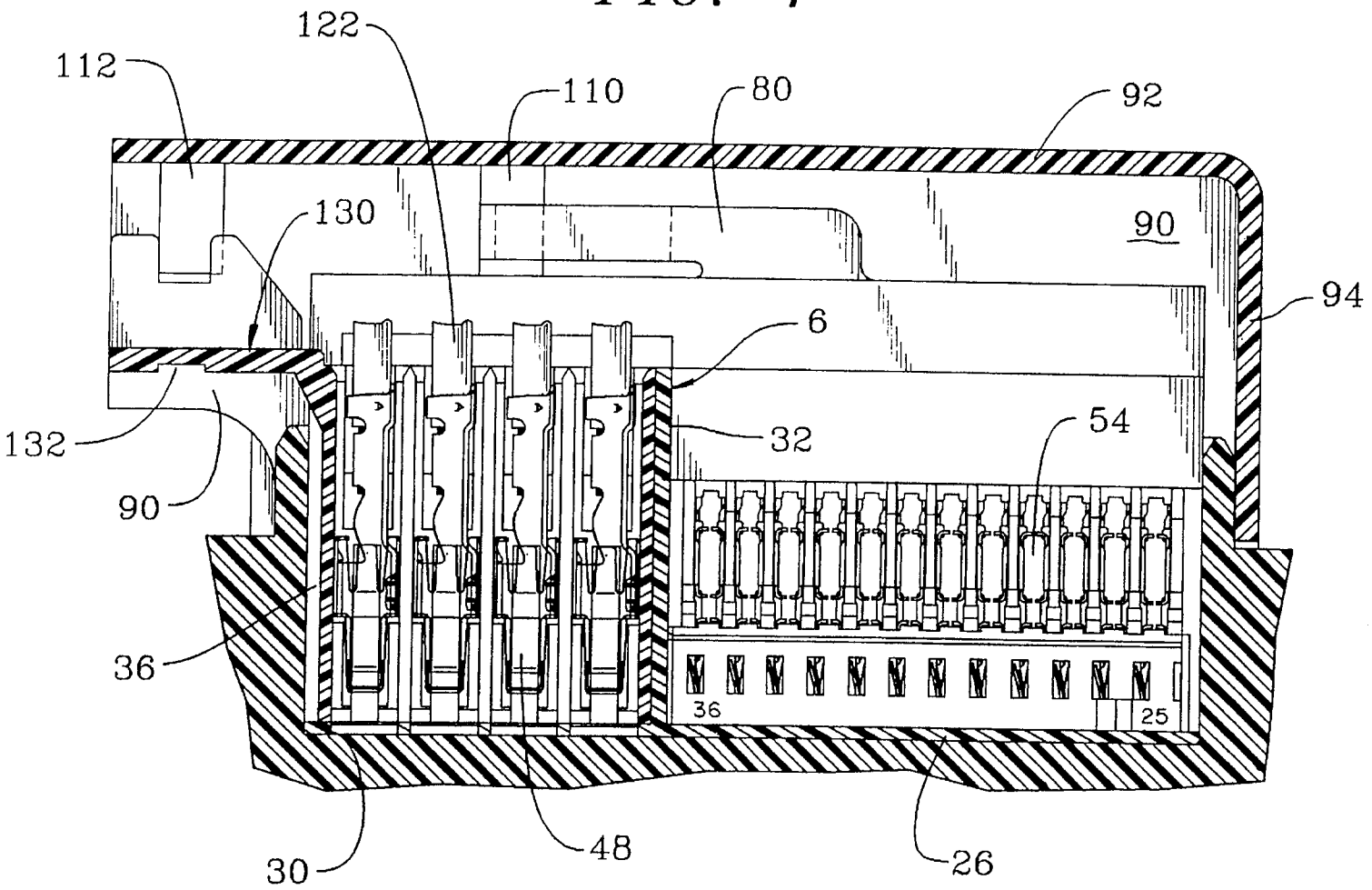
FIG. 4 is a longitudinal cross section through the connector assembly of FIG. 2.
Figure 5:
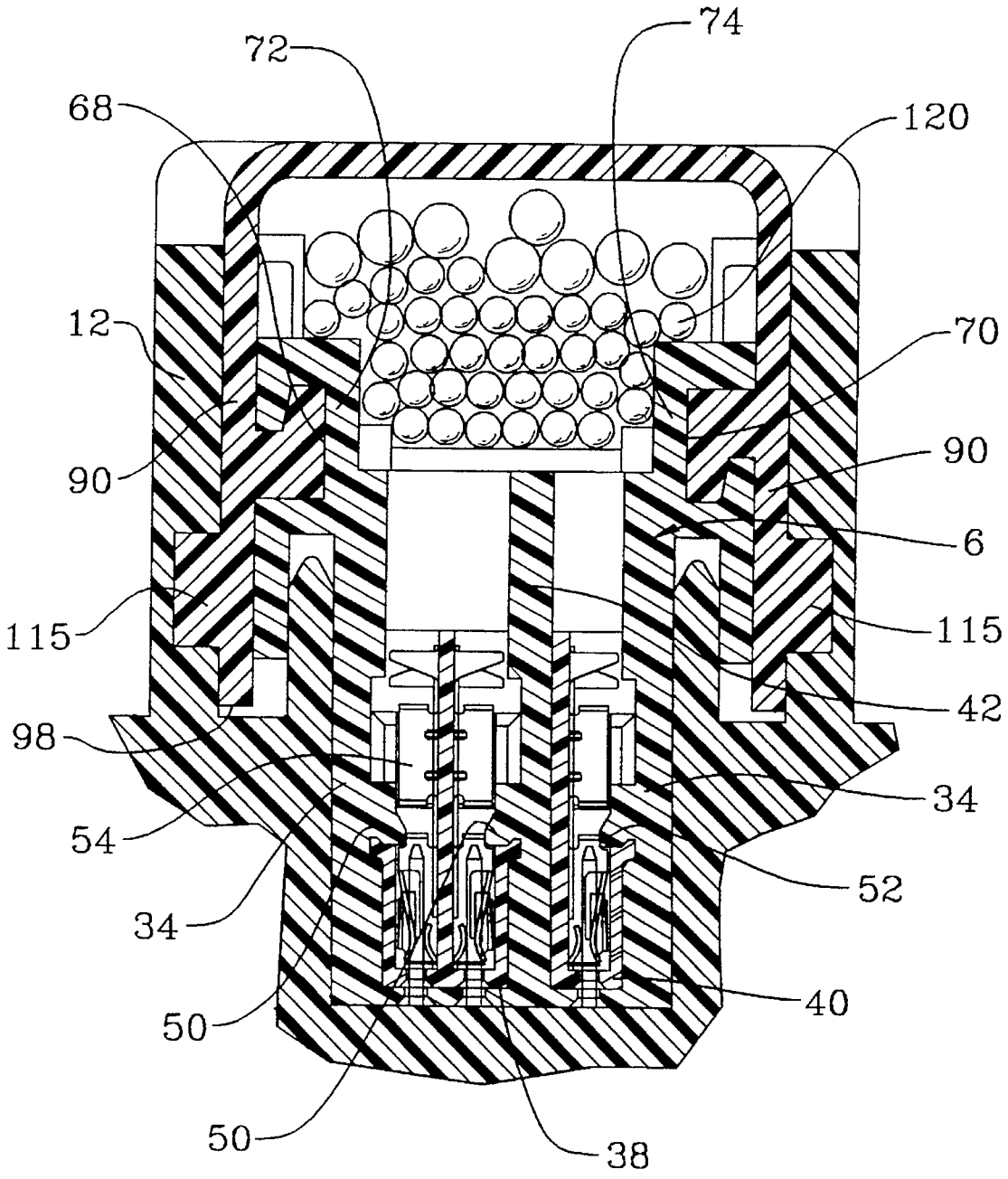
FIG. 5 is a cross sectional view through lines 5—5 of FIG. 2.
Figure 7:
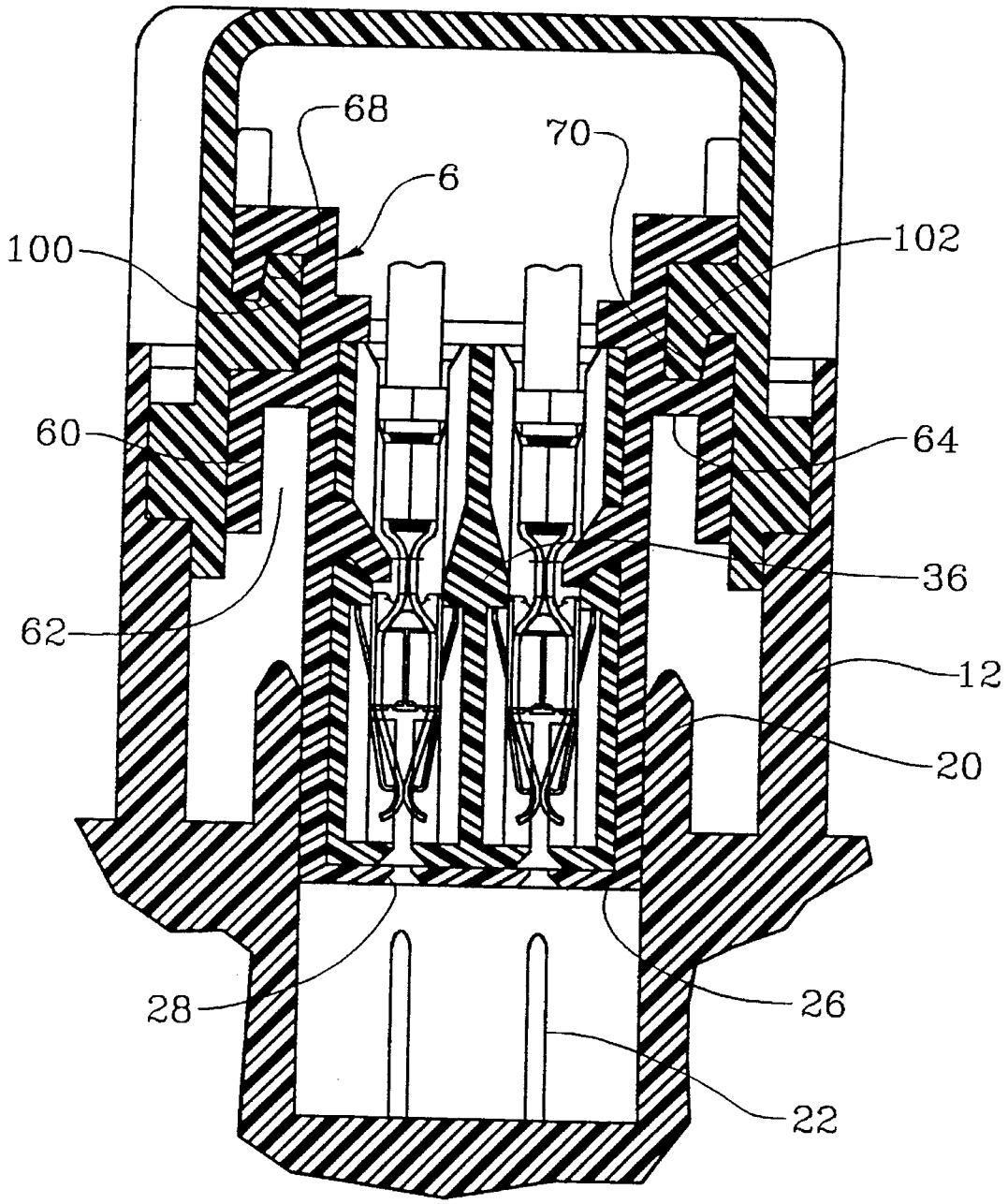
FIG. 7 is a cross sectional view through lines 7—7 of FIG. 1.

With respect now to FIGS. 1,4 and 5, the cover 8 is comprised of side walls 90, a top cover wall 92 and an end cover wall 94. The cover 8 is open along the left-hand side as viewed in FIG. 4, and along its front face 98 (FIG. 5) so as to be slidably received over the inner housing member 6 as described in greater detail herein. For this purpose, the side walls 90 include rail members 100,102, which are received in corresponding grooves 68 and 70 of the inner housing member 6, as best shown in FIG. 7. Finally, the inside surface of walls 90 include locking shoulders at 110, 112, whereas the outer surface of walls 90 include locking lugs at 115.

With the connector assembly as described above, the entire assembly can be completed in the following manner. Insulated conductors can be terminated to respective electrical terminals 48, where the terminals 48 are further inserted into terminal receiving passageways of its respective connector housing 36. The terminals will be inserted into a position shown in FIG. 6, where locking lances on the terminals are positioned behind shoulders of the housing 36 retaining them in position. The housing 36 can thereafter be slidably received into the left side of the inner housing 6 with the rails 34 being slidably received in the groove 46 of the housing 36, to a position where the housing 36 abuts the intermediate wall 32 as shown in FIG. 4. Insulated conductors can now be terminated to terminals 54 in the housings 38 and 40, by means of mass termination, and these respective housings 38 and 40 can be slidably received through the right hand side of inner connector 6 along respective rails 50 and 52 to the position shown in FIG. 4.

Figure 2:
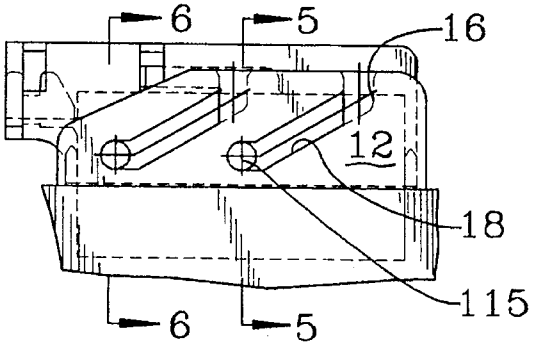
FIG. 2 is a view similar to that of FIG. 1 showing the connector assembly in a fully locked condition.

The insulated conductors 120 and 122 can now be gathered and positioned within a saddle member 130 on the connector housing 36 with a cable tie or other strain relief mechanism positioned in a groove 132 of the saddle member, to secure the assembly of the cables in a fixed manner. The cover 8 can now be slidably received over the inner housing member 6 with the corresponding rails and grooves 68,100; 70,102 to the position shown in FIG. 1, which also corresponds to a position where the latch arm 80 is engaged with the shoulder 112. The connector assembly 2 can now be assembled to the header member 4 such that the front face 26 of the housing member 6 is positioned within the peripheral shroud member 20, while at the same time the locking lugs 115 are lowered into the axial slot portions 16 of the camming grooves 14. The cover 8 is now pushed leftwardly from the position shown in FIG. 1 to the position shown in FIG. 2, causing the locking lugs 115 to follow the inclined camming groove portion 18, and at the same time bringing the inner housing 6 into a fully mated condition with the header member 4 to the position shown in FIGS. 4–6.

Advantageously, an electrical connector assembly is provided where first and second electrical connectors are drawn together by a mating slide, where said mating slide is incorporated as part of the cover of one of the connectors. The foregoing connector assemblies provide an advantage of reducing the number of components of the assembly. The foregoing connector assembly provides another advantage that when the cover is properly seated the connectors will be fully mated, thereby enabling easy detection of full mating as the positioning of the cover is easily compared to the first connector without reference to the second.

We claim:

1. An electrical connector assembly comprised of a first electrical connector, a second electrical connector, and a camming slide having either inclined camming grooves or camming lugs, with said second connector having either camming lugs or camming grooves, the assembly being characterized in that said camming slide is profiled as a cover member movable transversely of said first connector in an axially retained manner, from a prelocked position, where said camming lugs can enter said camming grooves, to a position where said cover member substantially encloses a rear wire entry face of said first connector.

2. The connector assembly of claim 1, characterized in that connector is profiled as a side wire entry connector.

3. The connector assembly of either of claims 1 or 2, characterized in that the first connector member includes a strain relief saddle which can receive therein, the cable terminated to terminals in said first connector.

4. The connector assembly of claim 3, wherein the strain relief saddle includes a groove for receiving a strain relief means therein.

5. The connector of claim 3, characterized in that said cover member is slidable to a position to overlie said strain relief saddle.

6. The connector of claim 1, characterized in that said cover and first connector have latching means to retain the cover in said prelocked position and fully enclosed position.

7. The connector of claim 3, characterized in that said strain relief saddle is positioned at an end of said first housing, and said cover is slidably moveable over said opposite end, to a position over said strain relief saddle.

8. The connector of claim 1, further characterized in that the cover includes rails which ride in corresponding grooves of the first connector to axially restrain the cover to the first connector.

9. The connector of claim 1, further characterized in that the camming slide is included within two opposing walls of the cover, the walls being received between upstanding walls of the second connector.

10. The electrical connector assembly of claim 1, wherein the first connector includes an outer ring defining an internal peripheral groove and the second connector includes a shroud profiled to fit within the groove when the connectors are in a fully locked position.

11. An electrical connector assembly comprised of a first electrical connector, a second electrical connector, and a camming slide having either inclined camming grooves or camming lugs, with said second connector having either camming lugs or camming grooves, wherein said camming slide is profiled as a cover member movable transversely of said first connector in an axially retained manner, from a pre-locked position, where said camming lugs can enter said camming grooves, to a position where said cover member substantially encloses a rear wire entry face of said first connector, and wherein the first connector member includes a strain relief saddle which can receive therein, the cable terminated to terminals in the said first connector.

12. The connector assembly of claim 11, wherein the connector is profiled as a side wire entry connector.

13. The connector assembly of claim 11, wherein the strain relief saddle includes a groove for receiving a strain relief means therein.

14. The connector assembly of claim 11, wherein said cover member is slidable to a position to overlie said strain relief saddle.

15. The connector assembly of claim 11, wherein said cover and first connector have latching means to retain the cover in said pre-locked position and fully enclosed position.

16. The connector assembly of claim 11, characterized in that said strain relief saddle is positioned at an end of said first housing, and said cover is slidably moveable over said opposite end, to a position over said strain relief saddle.

17. The connector assembly of claim 11, wherein the cover includes rails which ride in corresponding grooves to axially restrain the cover.

18. The connector assembly of claim 11, wherein the camming slide is included within two opposing walls of the cover, the walls being received between upstanding walls of the second connector.

19. The connector assembly of claim 11, wherein the first connector includes an outer ring defining an internal peripheral groove and the second connector includes a shroud profiled to fit within the groove when the connectors are in a fully locked position.

* * * * *